United States Patent [19]

Greenwood et al.

[11] Patent Number: 4,479,692

[45] Date of Patent: Oct. 30, 1984

[54] RECEPTACLE FOR FLAT MULTICONDUCTOR CABLE

[75] Inventors: William S. Greenwood, Nutley; Karl Weinmann, Watchung; Reinhold Weindel, Clinton, all of N.J.

[73] Assignee: Thomas & Betts Corporation, Raritan, N.J.

[21] Appl. No.: 337,661

[22] Filed: Jan. 7, 1982

[51] Int. Cl.[3] ..... H01R 13/39

[52] U.S. Cl. ..... 339/99 R; 339/14 R

[58] Field of Search ..... 339/97 R, 97 P, 98, 339/99 R, 14

[56] References Cited

U.S. PATENT DOCUMENTS

| | | | |
|---|---|---|---|
| 3,150,909 | 9/1964 | Deverell | 339/97 |
| 3,177,457 | 4/1965 | Croghan | 339/97 P |
| 3,255,429 | 6/1966 | Forney, Jr. | 339/99 |
| 3,723,948 | 3/1973 | Wyatt et al. | 339/99 |
| 3,857,994 | 12/1974 | Neale, Sr. | 174/78 |
| 3,910,672 | 10/1975 | Frantz | 339/97 P |
| 4,027,941 | 6/1977 | Narozny | 339/98 |
| 4,075,758 | 2/1978 | Parsons et al. | 29/628 |
| 4,240,687 | 12/1980 | Bunnell et al. | 339/99 |

*Primary Examiner*—Joseph H. McGlynn

*Attorney, Agent, or Firm*—Robert M. Rodrick; Salvatore J. Abbruzzese

[57] ABSTRACT

A receptacle for use with flat conductor cable is provided with a grounding contact that can be urged into electrically conductive contact with the cable grounding conductor and protective shield on such cable independently of the means by which other contacts in the receptacle are urged into electrically conductive contact with the respective live and neutral conductors of the cable.

28 Claims, 6 Drawing Figures

RECEPTACLE FOR FLAT MULTICONDUCTOR CABLE

FIELD OF THE INVENTION

The present invention relates to an electrical receptacle and, more particularly to a receptacle for use in making electrical connection with an insulated, flat multiconductor cable.

BACKGROUND OF THE INVENTION

Flat conductor cable (FCC) underlying carpet tiles is in present use to supply electrical power to various points of use, as for example, handling task lighting and appliance loads in commercial buildings. The flat conductor cable includes in a common form thereof a plurality of flat conductors i.e., live, neutral and grounding conductors encased in a plastic electrically insulative casing and additionally having a metallic shield disposed at the upper surface of the cable. A layer typically made of tough insulation material is provided on the bottom of the cable as an abrasion protection shield. The metallic shield is electrically grounded to provide against electrical hazard such as accidental piercing of the shield and the live conductor by an object. An advantage of the use of this type of conductor cable is the facility with which it can be installed beneath carpeting and carpet tiles while at the same time allowing for transfer of power therefrom at selected locations, pedestals or transfer receptacles being installed for such purpose.

Various specialized types of devices including receptacles are known for establishing power take-off from the flat conductor cable at a given location. Thus, for connecting a receptacle at a desired location, a terminal block carrying insulation piercing members or contacts can be secured over the flat conductor cable with the contacts piercing the flat conductor cable to establish continuity with the respective cable conductors. A receptacle can then be placed over the terminal block with suitable connection between the terminals of the block and contact points in the receptacle being made with round wire connectors. With such installation the cable run can be terminated at the take-off location or it may pass through the terminal block so that additional receptacles can be connected further down the line. It is also known to use for purposes of providing power take-off, a receptacle which embodies insulation piercing contacts therein and employed when installed directly over a conductor cable to have these piercing contacts electrically connectively engage the conductors in the cable.

One of the drawbacks of utilizing the types of devices described above for providing power take-off from a flat conductor cable is the difficulty of insuring positive and effectual maintenance of electrically conductive contact between the flat cable grounding conductor and the associated insulation piercing grounding contact in the terminal block if such is used, or between the cable grounding conductor and the associated insulation piercing grounding contact carried in the receptacle if that type of device is used directly on the cable. It is equally important to insure proper electrical contact between the grounding contact and any metallic grounding shield covering the cable. These prior art devices, be they terminal block or receptacle types produce contact between the insulation piercing contacts and the flat conductor cable conductors and any protective shield by pressure imparted from the terminal block in the one case or the receptacle body in the other, the pressure resulting from the tightening of fastening screws passing directly through the receptacle or fastening screws used to secure a base plate to the floor, which base plate in turn is used to clamp the terminal block securely in place over the flat conductor cable. Since it is commonplace to make the receptacle and the terminal blocks as one piece structures, and since it is commonplace to effect fastening at the ends thereof which are in regions immediately adjacent the flat conductor cable live and neutral conductors, such fastening can influence the degree of proper contact between the terminal block grounding conductor associated contacts or the receptacle grounding conductor associated contacts. Such influence is in spite of the fact that a further separate fastener may be used at a location centrally of the terminal block or receptacle, the region wherein the grounding contacts usually are carried in the terminal block or the receptacle. In fastening or clamping of prior terminal blocks or receptacles it is believed that such can produce a stress/strain condition in these structures causing them to bow upwardly slightly in the center and hence lessening the downward pressure imparted to the grounding contact at that location. Tightening of any centrally located fastening screw it is thought can be resisted by such a stress/strain condition sufficiently to impair the positive electrically conductive contact which should exist with respect to and between the receptacle or terminal block insulation piercing grounding contact on the one hand, and the cable grounding conductor and shield on the other.

SUMMARY OF THE PRESENT INVENTION

The present invention relates to improvements in receptacles used to provide a connection at a desired location to a flat conductor cable wiring system.

It is an object of the present invention to provide an improved form of receptacle for use with flat conductor cable embodying improved cable grounding conductor contact means as well as construction of the contact means and receptacle which assures effecting an optimal grounding continuity between such contact means and the flat cable grounding conductor and cable protective grounding shield.

Another object is to reduce the stress loading on the receptacle body produced by the installation screws with which the receptacle is secured in place at a pedestal location in a wiring circuit and the said screws are tightened forcing the receptacle downwardly against the cable to establish contact between the receptacle contact means and the cable conductors.

A further object is to provide a receptacle embodying an improved manner of arranging and retaining the contact means thereon.

In accordance with the present invention, an improved receptacle for use with flat conductor cable comprises an elongated receptacle body in which is carried contact means associated with the live and neutral conductors of the cable. The body is provided with a centrally located enlarged recess opening upwardly from the bottom thereof and which is receptive of a support block on which is carried the contact means associated with the grounding conductor of the cable. Each receptacle contact means is provided with a first insulation piercing contact portion which is disposed at the underside of the receptacle body and a second contact portion extending upwardly in the body and adapted to be electrically connectively engaged by, e.g., appliance plug prongs, when the prongs are inserted into appropriate openings at the top side of the body. The receptacle is as will be understood from later given description, designed such that the insulation piercing contact portion of the grounding contact on the one hand, and the insulation piercing contact portion of the live conductor contacts on the other hand, can be urged into engagement with the respective associated cable conductors independently of each other. When installing the receptacle at a selected take-off location in the flat cable wiring circuit, the cable will be placed in overlying position on a support member which itself can be fixedly secured to, e.g., a floor. The metallic protective shield at the top side of the cable is removed from or cut back at selected locations over both the live and neutral conductors of the cable. The receptacle is then placed on top of the cable and secured at both ends thereof to the support member with screw fasteners, such action resulting in the downward urging of the receptacle against the cable and to the extent that the insulation piercing first portions of the live and neutral contact means at the bottom side of the receptacle body pierce the insulation covering the cable live and neutral conductors at the above-mentioned selected locations and are forced into electrically conductive contact with said conductors. The thus described securement of the receptacle over the cable can also have the effect of causing the insulation piercing first portion of the grounding contact means to pierce the cable protective shield remaining in overlying relation to the cable grounding conductor and to pierce the insulation covering said conductor as well. Since however, the integrity of the contact effected between the receptacle grounding contact means and the cable grounding conductor and protective shield must be maintained to assure essential and proper grounding circuit continuity and since the stress/strain effect created in the receptacle body by end securement thereof could thwart achievement of such assured contact, separate grounding fastening means is employed. The grounding fastening means such as a screw fastener connectable with the support member is received through an opening in the receptacle body and also passes through the support block carrying the receptacle grounding contact means with the screw fastener having an enlarged head which comes into abutment contact with the block. By fastening the screw to the support member, the support block and hence the grounding contact means first portion, since the support block is free to move up and down in the body recess, is forced into piercing contact through the protective shield and overlying insulation of the cable grounding conductor into firm contact with said conductor independently of the effect of any downwardly urging securement of the receptacle to the support member. There is thus achieved positive grounding circuit continuity among the cable grounding conductor, cable shield, receptacle grounding contact means and the grounding fastening means.

The live, neutral and grounding contact means second portions in the receptacle can be provided with two like branches so that the receptacle can be used for reception of two appliance plugs, each having a live, neutral and grounding prong.

In addition to its serving to carry the grounding contact means, the support block is used, due to the manner is which the live and neutral contact means are disposed in the receptacle, as a retainer to hold such live and neutral contact means securely in place.

The receptacle body in accordance with the present invention can be provided with features which insure that it will be properly oriented by the installer when it is placed on top of the flat cable at the time of securement to the support member thereby to insure that proper circuit polarity is maintained. Thus companion and cooperative telltale means can be provided on the receptacle and support member which, if not brought into proper installation alignment, precludes the installation screws passing through the receptacle from registering with the intended threaded receptive openings in the support member. Further the underside of the receptacle can be provided with downwardly depending tabs which can only be received in apertures in the support member if the receptacle is properly positioned.

The invention accordingly comprises the receptacle having the combination of elements and arrangements of parts as will be exemplified in the construction and description hereinafter set forth and the scope of the invention will be indicated in the claims.

BRIEF DESCRIPTION OF THE DRAWINGS

A fuller understanding of the nature and the objects of the present invention will be had from the following detailed description taken in conjunction with the accompanying drawings in which.

Throughout the description, like reference numerals are used to denote like parts in the drawings.

DESCRIPTION OF THE PREFERRED EMBODIMENTS

Figure 1:
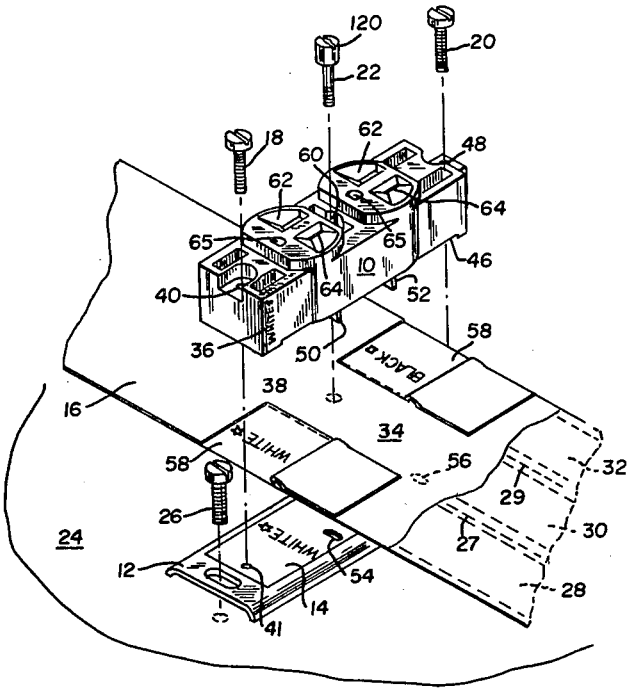
FIG. 1 is an exploded view in perspective showing the relative positioning of the components employed to effect pedestal installation for a flat conductor cable at a desired location, such components including the improved receptacle constructed in accordance with the present invention.

Referring to FIG. 1, the assembly of components used for installing a flat conductor cable receptacle 10 at a given location in a flat conductor cable wiring circuit includes in addition to the receptacle 10, a support member 12 including an insulated covering 14 preferably secured to the support member and the flat conductor cable 16 and the respective end fastener screws 18, 20 and a grounding fastener screw 22. Support member 12 with the insulated covering 14 is adapted to be secured to, e.g., a floor surface 24 with securement screws 26 at each end, only one such securement screw being shown in FIG. 1. Flat conductor cable 16 is of a known type, e.g., that disclosed in U.S. Pat. No. 4,219,928 and includes respective laterally spaced live, grounding and neutral conductors 28, 30, 32 encased in an insulative covering having perforations 27 and 29 separating the conductors and surmounted by a metallic protective shield 34. A layer of abrasion resistant material (not shown) is preferably on the bottom of the cable 16. The receptacle 10 carries indicia as at 36 which are cooperative with like indicia 38 on the cable indicative of proper receptacle orientation to insure correct polarity of electrical connections to be made. Further in this regard and to insure proper placement orientation of the receptacle on the cable, the receptacle has a fastener screw through passage 40 which functions as a telltale cooperative with like telltale openings 41 in insulated covering 14 and support member 12 when correct receptacle placement is effected to indicate such condition and thereby allow screw 18 to pass through for securement of the receptacle to the support member. As an additional feature designed to eliminate possibility of improper receptacle orientation on the cable, the side walls 42, 44 (FIG. 2) of the receptacle have their lower edges notched upwardly as at 46 for an intermediate distance between the receptacle ends with the termini of the notches in close fitting embrace with the opposite side edges of the cable and demarking the cable lateral extremities. One terminus of each notch is located closer to its associated receptacle end than the other terminus to its associated receptacle end. When therefore the receptacle is placed over the cable in correct orientation and hence proper polarity, the passage 40 will align with openings 41. If the receptacle was installed with a reciprocal orientation, the notches 46 would fit the cable snuggly but the passage 48 associated with fastener screw 20 would not align with openings 41 and screw 18 could not be inserted through the complete assembly. Notches 46 also accomodate the thickness of the flat cable and provide space in which the soon to be described receptacle insulation piercing contact means first portions are disposed. Another safeguard that insures that proper orientation must be employed to install the receptacle is provided by tabs 50, 52 at the underside of the receptacle which must pass through the cable preferably at the perforations 27 and 29 between the grounding conductor 30 and the live and neutral conductors and be received in openings 54, 56 in the insulated covering 14 and support member 12 in order for the receptacle to seat properly. If reciprocal orientation were attempted, the tabs would not line up with openings 54, 56 and hence not pass therethrough preventing proper seating. The receptacle is provided at the topside thereof with a generally centrally disposed passage 60 receptive of grounding fastening screw 22 and also with openings 62, 64 for receiving appliance plug prongs associated with power transfer, and openings 65 associated with the plug grounding prongs.

With continued reference to FIG. 1, the protective metallic or grounding shield 34 on top of cable 16 will as a preliminary to connecting the receptacle thereto be removed or cut and laid back in the rectangular pattern as at 58 in regions overlying the live and neutral conductors 28, 32 in the cable leaving exposed the insulative covering in which said conductors are encased. It is preferable that the shield be cut and laid back by folding same rightwardly on top of uncut portions of the shield since this facilitates effecting repair to the shield in the event the receptacle is removed. More specific consideration of receptacle 10 will be given next and with continuing reference to FIGS. 2–4.

Figure 6:
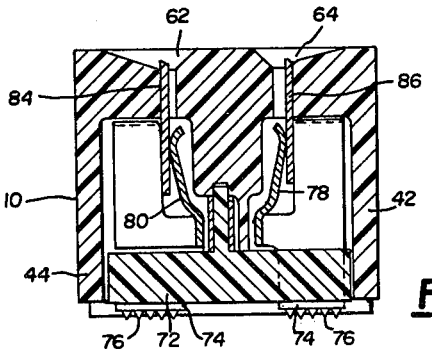
FIG. 6 is a transverse sectional view of the receptacle as taken along the lines VI—VI of FIG. 3.
Figure 2:
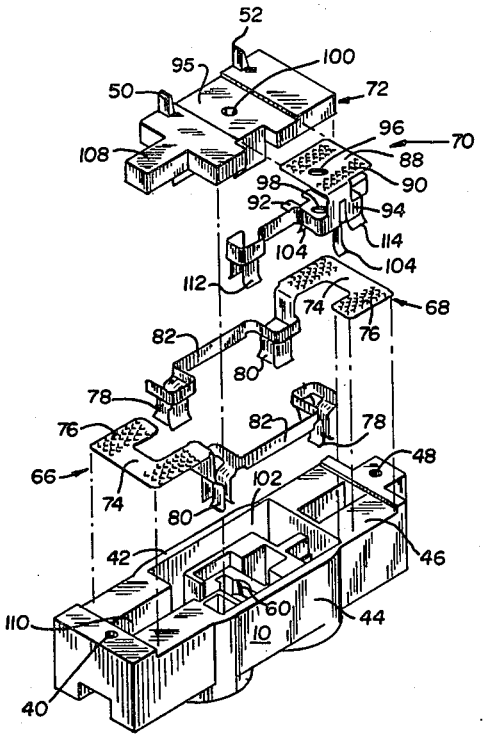
FIG. 2 is an exploded, bottom perspective view of the receptacle shown in FIG. 1 illustrating the support block and the cable live, neutral and grounding conductor associated contacts and the manner in which such contacts are positioned in the receptacle body.

Receptacle 10 is an elongated body made of electrically insulative material formed preferably as a molded structure of generally rigid durable character. Formed within the molded structure at the underside thereof are suitable conformably configured grooves for receiving the flat cable live conductor associated contact means 66 and the cable neutral conductor associated contact means 68. As FIG. 2 illustrates, the cable grounding conductor associated contact means 70 is carried on a support block 72 which shall be described in greater detail shortly. The contact means 66, 68 are identically configured members. Each of said contact means has a first contact portion 74 in the form of a thin broadened plate-like member and fitted with insulation piercing teeth 76 struck from the plate material in the manner, e.g., described in U.S. Pat. No. 3,549,786. The first portions of these contact means when such means are in retained position in the receptacle body are disposed at the underside of the receptacle and in facing relation to the flat cable on which the receptacle is positioned, the first portion of one contact means adjacent one end of the body and the first portion of the other adjacent the other body end. Each contact means also has a second contact portion which extends upwardly in the receptacle towards its top side and communicating with the body openings 62, 64. Such second contact portions desirably are formed as two like branches 78, 80 joined by a bus 82. The two branches of each of the respective live and neutral contact means cooperate to form two pairs of prong receiving contacts to transfer power to two appliances. FIG. 6 illustrates how these branches 78, 80 are disposed in the receptacle body and how two external power prongs 84, 86 of a plug are engaged therewith.

Figure 5:
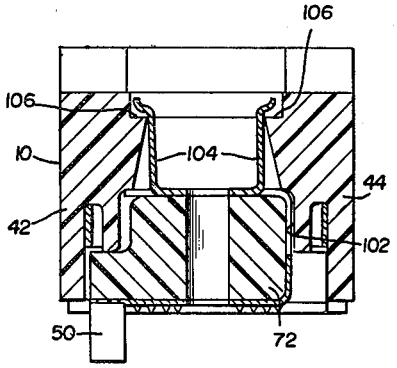
FIG. 5 is an enlarged view of the FIG. 4 illustration with the cover, screw fastener and support member removed.

FIG. 2 further shows that grounding contact means 70 is a single piece, shaped member having a first plate-like contact portion 88 also fitted with insulation piercing teeth 90, a spaced plate-like extension 92 joined by strut 94 to portion 88 and forming a skirt embracing the support block 72 with portion 88 being received in slot 95 of the block. Grounding contact means 70 also includes the like branch contact pieces 112, 114 which receive the grounding prongs on appliance plugs inserted into the receptacle, such contact pieces being in communication with body openings 65. This contact means also includes openings 96, 98 alignable with opening 100 in the block and through which openings the main shaft length of grounding fastener screw 22 passes. To accomodate support block 72, the receptacle body has an enlarged generally centrally disposed upwardly opening recess 102, the block closely fitting within the recess but yet being moveable upwardly and downwardly therein. For retaining the support block within the receptacle body, the grounding contact means is provided with flexible fingers 104 which extend upwardly in the body to engage with body detent shoulders 106 (FIG. 5) and hold the block captively but moveably retained in the receptacle body. Support block 72 also is provided at one end with a tongue-like extension 108 which is received in groove 110 of the receptacle body for properly orienting the support block when assembling same with the body, and also carries the alignment tabs 50, 52 referred to above and used in effecting alignment of the receptacle in proper orientation on the cable.

Figure 4:
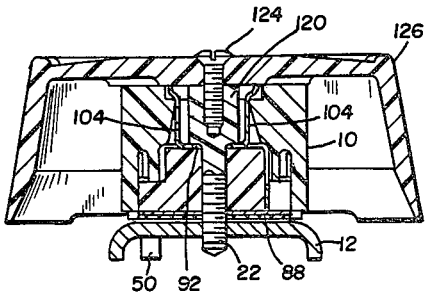
FIG. 4 is a transverse central sectional view in elevation of the receptacle as seen along lines IV—IV of FIG. 3 with the receptacle cover in place.
Figure 3:
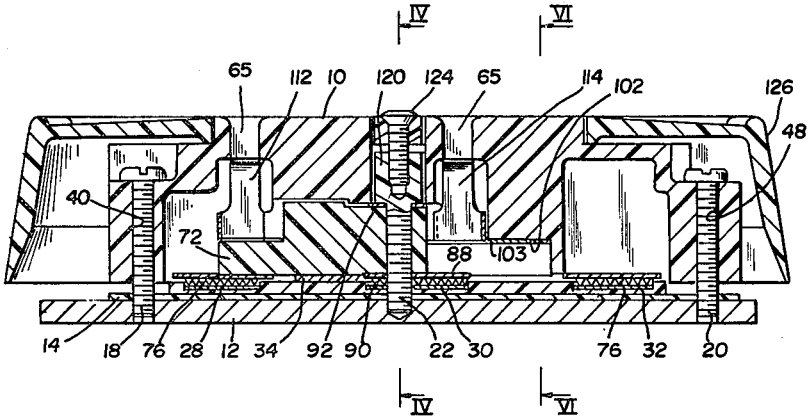
FIG. 3 is a longitudinal central sectional view in elevation depicting the manner in which the receptacle is connected to the support member and further the manner in which the grounding screw is employed to urge the grounding contact means into electrically conductive engagement with the cable grounding conductor, there also being shown a receptacle cover secured over the receptacle with a screw fastener received in the grounding screw.

When installing the receptacle and assuming that all preliminaries have been properly carried out inclusive of support member and insulating covering placement and shield lay-back, the receptacle having been properly oriented is placed on top of the cable, it is pressed down to cause tabs 50, 52 to penetrate and pass through the flat conductor cable at the perforations 27 and 29 and register in openings 54, 56 of the insulating covering. Fastening screws 18 and 20 are inserted through the respective openings 41, the openings 41 in support member being threaded, and ground fastening screw 22 is received in body passage 60. The tip end of screw 22 is of conical configuration to facilitate its penetration of the protective shield 34, cable insulative covering and the grounding conductor 30 itself. Screw 22 passes through the receptacle as seen in FIGS. 3 and 4 and its widened head portion 120 engages in stopped abutment with the support block 72 and grounding contact means extension 92, the openings 96, 98 and 100 being sufficient only to accomodate the narrower shaft portion of the screw. All of screws 18, 22 and 20 are made up tight and this results in forcing the receptacle downwardly against the cable. As illustrated in FIG. 3, sufficient downward pressure is involved to result in the teeth 76 on the first portions 74 of the respective contacts piercing the cable coverings and coming into good electrically conductive contact with the cable live and neutral conductors 28 and 32. Since the support block 72 is free to move independently of the receptacle body the grounding contact teeth 90 can be, by tightening screw 22, urged into optimum electrically conductive contact with the protective shield 34 and also the cable grounding conductor 30 independently of the downwardly urging pressure of the receptacle and created by tightening screws 18 and 20. Upon such tightening of the grounding screw 22, a spacing 103 preferably exists between the upper surface of the support block 72 and the bottom surface of the recess 102 of the receptacle 10 indicative of the independence of these components in assembly. There is thus assured establishment of continuity in the grounding circuit, since the grounding screw itself is in good electrically conductive contact with the contact means. The widened head part 120 of screw 22 can itself be tapped for reception of a screw 124 used to secure a cover 126 in place over the receptacle.

The advantages of the above-described receptacle construction are several and include:

1. The connection and continuity between the grounding contact and the protective shield and grounding conductor of the cable is not influenced by any stress and consequent strain and/or bending which might be created in the receptacle body by the tightening of the installation screws 18 and 20. Since the grounding contact is in the center of said receptacle body, it would be the most likely connection to be influenced by such a stress/strain condition.

2. The elimination of the loading points in the central portion of the receptacle due to the grounding screw, and the resultant forces exerted by the contact bearing against the receptacle body, serves to reduce the stress and bending reactions within said body. This results in a more stable assembly less likely to exhibit cracking and electrical connection degradation.

3. A safety feature is realized by having the grounding screw 22 bear directly upon the portion of the grounding contact directly above the contact establish teeth. It is, thereby, better assured that the grounding screw will always be at gound potential after it has been tightened to the proper installing torque. It is additionally assured that articles subsequently secured to the thread of the grounding screw, such as a metallic housing or cover, would also be at ground potential.

Various modifications to the foregoing particularly described receptacle will now be evident to those skilled in the art and may be introduced without departing from the invention. For example, the support block and grounding contact means in the receptacle could be urged into contact with the flat conductor cable by means other than the fastener screw 22. Thus instead of using a fastener screw connectable to the support member downwardly urging of the support block independently of the effect of securing the receptacle to said support member could be effected by using a pressure screw bearing against the top of the support block and carried in a threaded bushing fixed in the receptacle. Thus the foregoing preferred embodiments discussed and shown in the drawings are intended in an illustrative and not in a limiting sense. The true spirit and scope of the invention is set forth in the following claims.

We claim:

1. A receptacle for use with flat conductor cable and adapted for placement thereof on top of said cable in disposition spanning respective laterally spaced live grounding and neutral conductors extending longitudinally in said cable and being cooperatively securable to a support member underlaying said cable, said receptacle comprising an elongated body having a cable engaging bottom side and a power transfer access top side, contact means associated with said live and neutral conductors of said cable carried in said body and including first insulation piercing contact portions disposed at the body bottom side and effective when said body is urged downwardly against said cable during securement thereof to said support member to pierce cable insulation covering said live and neutral conductors, said contact means including second contact portions extending from the first portions toward the top side of said body and positioned within said body such as to be electrically connectively engaged by the contact members of a plug connector when said plug connector is receptively engaged in said receptacle at the top side thereof, said body having a recess opening upwardly therein from the bottom side, a support block receivable in said recess and moveable upwardly and downwardly therein relatively of said body, contact means associated with said cable grounding conductor carried on said support block and having a first insulative piercing contact portion disposed in facing relation to said cable and a second contact portion extending toward the top side of said body when said block is received in said recess with said second contact portion being positioned such as to be electrically connectively engaged by a grounding contact member of said plug connector, and means for urging said support block and the cable grounding conductor associated contact means carried thereon downwardly relatively of said body independently of the effect of any downwardly urging securement of said elongated body to said support member thereby to cause said grounding conductor associated contact means first portion to pierce the covering over said cable grounding conductor and electrically conductively contact said cable grounding conductor.

2. The receptacle of claim 1 in which the first contact portions of the contact means associated with the respective cable conductors are provided with a plurality of teeth constituting cable insulation piercing members.

3. The receptacle of claim 1 in which said support block has a tongue extension thereon, and said body is provided with a groove receptive of said tongue for properly assembly orienting said block for reception in said body recess.

4. The receptacle of claim 1 in which said support block is provided with tabs depending outwardly therefrom and when said body is received on said cable passing through said cable for reception thereof in openings in said support member to effect proper alighment of the receptacle on said cable.

5. The receptacle of claim 1 in which said block urging means comprises a grounding fastening screw receiveable in said body and passing through said support block for securement of said fastening screw to said support member, said fastening screw further having structure in abutment contact with said block.

6. The receptacle of claim 5 in which said grounding screw fastener has a head portion widened relatively of the passage in said support block through which the major length of said screw passes, the head portion being in abutment contact with said support block when connected with said support member.

7. The receptacle of claim 6 in which said cable grounding conductor contact means is disposed on said support block in embrace of both the upper and lower surfaces of said block whereby the screw fastener when connected with said support member passes through said contact means and is in grounding circuit continuity with both said contact means and said cable grounding conductor.

8. The receptacle of claim 6 in which the head portion of said screw fastener is provided with a bored passage for reception therein of a receptacle cover fastening means.

9. The receptacle of claim 1 in which the second contact portions of the contact means associated with the cable live and neutral conductors each have two like branches with each branch of the said second contact portion associated with the cable live conductor cooperating with a branch of the said cable neutral conductor associated second contact portion to therewith define two separate pairs of power transfer contacts adapted for receptive engagement with the contact members of two separate plug connectors.

10. The receptacle of claim 9 in which the second contact portion of the contact means associated with the cable grounding conductor has two like branches one each of which is associated with one of the separate pairs of power transfer contacts.

11. The receptacle of claim 1 in which the first contact portion of the cable live conductor associated contact means is disposed adjacent one end of said body and the first contact portion of the cable neutral conductor associated contact means is disposed adjacent the other end of said body.

12. The receptacle of claim 11 in which the first contact portion of the cable grounding conductor associated contact means is disposed when said block is received in said recess proximately centrally between the ends of said body.

13. The receptacle of claim 11 in which the second contact portion of the respective contact means associated with the cable live and neutral conductors are disposed within said body extending such as to extend into said recess, said support block when received in said recess retaining said live and neutral contact means in said body.

14. The receptacle of claim 1 in which said elongated body has opposite side walls, the lower edges of said side walls for an intermediate distance between the ends of said body being notched upwardly a distance to demark a cable lateral extremities embracing structure.

15. The receptacle of claim 14 in which one terminus of said intermediate distance is closer to its associated body end than the other terminus is to its associated body end, the receptacle carrying telltale means cooperative with companion telltale means on said support member indicative of proper orientation and alignment placement of the receptacle over the cable, positioning of a given one of said termini at one cable lateral extremity defining a condition of proper placement, positioning of the other one of said termini at said one cable lateral extremity defining a condition of improper placement.

16. The receptacle of claim 1 comprising means for captively but moveably retaining said support block in said body recess.

17. The receptacle of claim 16 in which said captively retaining means comprises fingers on said cable grounding conductor associated contact means, said fingers being receivable in detent notches formed in said body.

18. A receptacle for electrical connection to flat multiconductor cable comprising:

a housing having a cavity therein;

first contact means supported by said housing, said first contact means having a terminal portion for external connection thereto and an insulation piercing portion disposed to engage a conductor of said flat multiconductor cable;

a support member movably disposed within said cavity;

second contact means supported by said support member for movement therewith, said second contact means having a terminal portion for external connection thereto and an insulation piercing portion disposed to engage another conductor of said flat multiconductor cable; and means for independently urging said insulation piercing portions of said first and second contact means into engagement with said respective conductors of said cable.

19. The receptacle of claim 18 further comprising means for captively but moveably retaining said support member in said cavity.

20. The receptacle of claim 18 further comprising means for limiting movement of said support member along a predetermined direction.

21. In a receptacle for use with flat elongate multiconductor electrical cable and adapted for placement on said cable in disposition spanning plural laterally spaced conductors extending longitudinally in said cable, including an elongate housing having a length at least sufficient to span the lateral expanse of said conductors in said cable, plural contact means supported by said housing associated separately with said cable conductors, said plural contact means being longitudinally spaced in said housing for individual lateral registration with respective cable conductors, each of said contact means having a terminal portion for external connection thereto and an insulation piercing portion disposed to pierce cable insulation and engage a respective conductor of said cable, and means for urging the insulation piercing portions of said contact means into engagement with the respective cable conductors, wherein the improvement comprises:

a conductive urging member supported by said housing in registry with a selected one of said contact means for independently conCtacting such selected one contact means and urging the insulation piercing portion thereof into engagement with a respective cable conductor, said urging member further comprising means for extending through said contact means and into piercing relation with said selected cable conductor.

22. A receptacle according to claim 21, wherein said urging member is a threaded member having a shoulder portion for contacting said contact means, the threads of such threaded member defining such means for providing piercing relation with said selected cable conductor.

23. In combination, a flat elongate multiconductor electrical cable having longitudinally extending, laterally spaced plural conductors, one of which is at ground potential, encased in electrical insulation;

a flat elongate metallic ground shield extending lengthwise with said cable having lateral expanse sufficient to extend across the width of said cable conductors; and a receptacle electrically connected to said cable and to said ground shield having an insulative housing spacedly supporting plural contact means each associated respectively with one of said cable conductors, each of said contact means having a terminal portion for external connection thereto and an insulation piercing portion, the insulation piercing portion of a contact means associated with a conductor other than said ground conductor directly piercing insulation adjacent such other conductor and being in electrical engagement therewith, said insulation adjacent said other conductor having been exposed by a displaced portion of said ground shield, a portion of said ground shield being interposed between said cable and the contact means associated with said ground conductor, the insulation piercing portion of such contact means associated with said ground conductor piercing both the interposed ground shield portion and the insulation adjacent said ground conductor and being in electrical engagement with said ground conductor.

24. The combination according to claim 23, wherein said cable includes live, ground and neutral conductors, wherein said receptacle includes first, second and third contact means associated respectively with said live, ground and neutral conductors, the insulation piercing portion of the first and third contact means piercing insulation adjacent the live and neutral conductors and being in electrical engagement respectively therewith.

25. A receptacle for electrical connection to a flat multiconductor cable having a plurality of laterally spaced flat conductors encased in insulation, comprising:

an elongate housing adapted for placement laterally on said cable and having a length at least sufficient to span the lateral expanse of said conductors in said cable;

plural contact means supported by said housing for separate association with said cable conductors, said plural contact means being longitudinally spaced in said housing for individual lateral registration with respective cable conductors, each of said contact means having a terminal portion for external connection thereto and an insulation piercing portion disposed to pierce cable insulation and engage a respective conductor of said cable;

a support member adapted for placement underneath said cable;

securement means for securing said housing to said support to thereby sandwich said cable therebetween and cause said respective insulation piercing portions of said contact means to pierce said cable insulation and engage the respective conductors, said securement means including at least one securement member disposed in registry with a selected one of said contact means and extending therethrough, said securement member having an extent extending from said housing to connected receipt in said support member and having insulation piercing expanse for piercing through said cable insulation and through said conductor to be in registry with said selected one of said contact means.

26. A receptacle according to claim 25, wherein said securement member is a threaded member defining said insulation piercing expanse.

27. A receptacle according to claim 26, wherein said selected one of said contact means includes an opening for receipt therethrough of said threaded member.

28. A receptacle according to claim 26, wherein said securement means includes at least two further threaded members disposed longitudinally outwardly of said one threaded member along said housing, said two further threaded members being spaced to lie laterally exteriorly of said cable for direct connected receipt in said support member.

* * * * *